US005902142A

United States Patent [19]

Kondo et al.

[11] Patent Number: 5,902,142

[45] **Date of Patent: *May 11, 1999**

[54] CONNECTOR FOR A FLEXIBLE PRINTED CIRCUIT BOARD OR A FLEXIBLE FLAT CABLE

[75] Inventors: Takeshi Kondo; Naoki Hayashi, both of Kanagawa-ken, Japan

[73] Assignee: Kyocera Elco Corporation, Kanagawa-Ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/760,819

[22] Filed: Dec. 5, 1996

[30] Foreign Application Priority Data

Apr. 26, 1996 [JP] Japan ..... 8/107245

[51] Int. Cl.[6] ..... H01R 11/22

[52] U.S. Cl. ..... 439/267; 439/495

[58] Field of Search ..... 439/266, 267, 439/268, 67, 77, 492, 495

[56] References Cited

U.S. PATENT DOCUMENTS

| | | | |
|---|---|---|---|
| 4,576,427 | 3/1986 | Verbruggen | 439/267 |
| 4,759,726 | 7/1988 | Naylor et al. | 439/725 |
| 5,044,972 | 9/1991 | Ikeda | 439/268 |
| 5,102,346 | 4/1992 | Soes | 439/268 |
| 5,451,172 | 9/1995 | Suan et al. | 439/267 |
| 5,542,855 | 8/1996 | Asai | 439/495 |

*Primary Examiner*—Hien Vu
*Attorney, Agent, or Firm*—McCormick, Paulding & Huber

[57] ABSTRACT

A connector for a flexible printed circuit board or flexible flat cable includes an insulator having an insertion opening for a flexible printed circuit board or a flexible flat cable, a plurality of contacts supported by the insulator, contact leg portions formed on the contacts, which come into elastic contact with an upper or lower inner surface of the insertion opening in the insertion direction, and a pusher which is adapted to elastically deform the contact leg portions to disconnect the latter from the inner surface of the insertion opening.

3 Claims, 2 Drawing Sheets

CONNECTOR FOR A FLEXIBLE PRINTED CIRCUIT BOARD OR A FLEXIBLE FLAT CABLE

BACKGROUND OF THE INVENTION

1. Field of the Invention

The present invention relates to a connector for connecting a flexible printed circuit (FPC) board or a flexible flat cable (FFC) to a group of contacts.

2. Description of Related Art

In general, a conventional connector for an FPC board or FFC (referred to as an FPC/FFC connector) is essentially comprised of an insulator having a group of contacts (contact group), and a slider. The insulator is provided with an insertion opening for a slider, opposed to the contact group. When the slider is inserted in the opening after the FPC/FFC has been inserted therein, contact pressure is produced between the FPC board or FFC and the contacts. There are two major types of connectors, i.e., a first type in which the slider is linearly inserted in the opening of the insulator and a second type in which the slider is inserted in the insertion opening by the rotational movement of the slider. In either type, it has been considered necessary to insert both the FPC and the slider in the insertion opening of the insulator.

SUMMARY OF THE INVENTION

It is an object of the present invention to provide an improved FPC connector in which no slider is necessary.

The basic concept of the present invention resides in a contact leg portion provided on each contact to come into elastic contact with the inner surface of the insertion opening, so that the FPC board or FFC can be held between the contact leg portion and the inner surface of the insertion opening, and thus no slider is necessary.

Namely, according to the present invention, there is provided a connector for a flexible printed circuit board or flexible flat cable, comprising an insulator having an insertion opening for a flexible printed circuit board or a flexible flat cable, a plurality of contacts supported by the insulator, contact leg portions formed on the contacts, which come into elastic contact with an upper or lower inner surface of the insertion opening in the insertion direction, and a pusher which is adapted to elastically deform the contact leg portions to disconnect the leg portions from the inner surface of the insertion opening.

The insulator is preferably provided with a pusher sliding hole connected to the insertion opening, so that the pusher can be inserted in or removed from the pusher sliding hole.

The pusher can be detachably attached to the insulator and can be commonly used for a plurality of connectors.

Preferably, the contacts are each provided with a soldering leg portion which extends toward a substrate to which the insulator is to be secured, an immovable leg portion which extends along the inner surface of the insertion opening on the substrate side, and an elastically deformable leg portion which is formed by bending the inlet end of the immovable leg portion that is located adjacent to the inlet end of the insertion opening into a U-shape, said contact leg portions being provided on the elastically deformable leg portions.

Preferably, the elastically deformable leg portions are each provided, on the more inward portion thereof in the insertion opening than the contact leg portions, with a pressure receiving portion which can be pressed by the pusher.

According to another aspect of the present invention, a connector for a flexible printed circuit board or flexible flat cable comprises an insulator having an insertion opening for a flexible printed circuit board or a flexible flat cable, a plurality of contacts supported by the insulator, and contact leg portions formed on the contacts, which come into elastic contact with an upper or lower inner surface of the insertion opening in the insertion direction. The FPC board or FFC is inserted between the contact leg portions and the inner upper or lower surface of the insertion opening while applying the pressing force to the contact leg portions to disconnect the latter from the inner surface of the insertion opening. The pressing force applied to the contact leg portions is released to return said elastically deformed contact leg portions to come into contact with said upper or lower inner surface of said inserting opening.

The present disclosure relates to subject matter contained in Japanese Patent Application No. 8-107245 (filed Apr. 26, 1996) which is expressly incorporated herein by reference in its entirety.

BRIEF DESCRIPTION OF THE DRAWINGS

The invention will be described below in detail with reference to the accompanying drawings, in which.

DESCRIPTION OF THE PREFERRED EMBODIMENT

Figure 1:
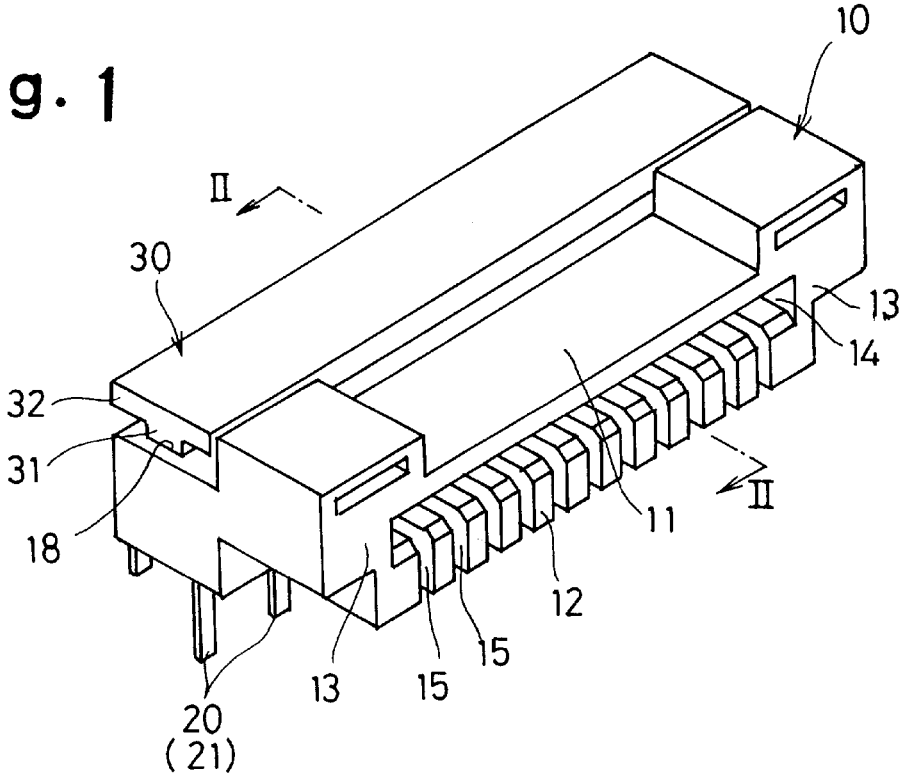
FIG. 1 is a perspective view of an FPC/FFC connector according to an embodiment of the present invention.
Figure 2:
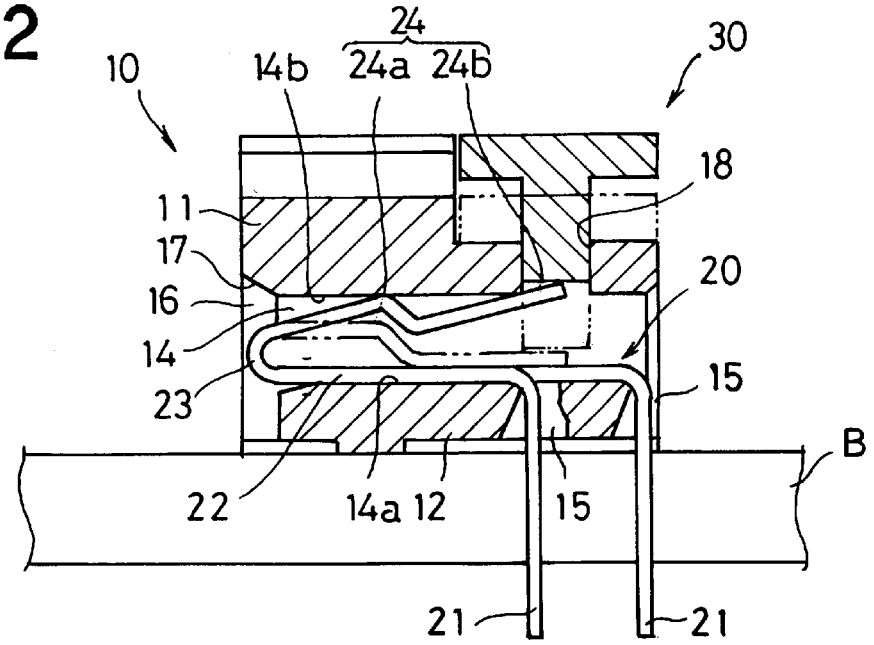
FIG. 2 is a sectional view taken along the line II—II in FIG. 1.
Figure 3:
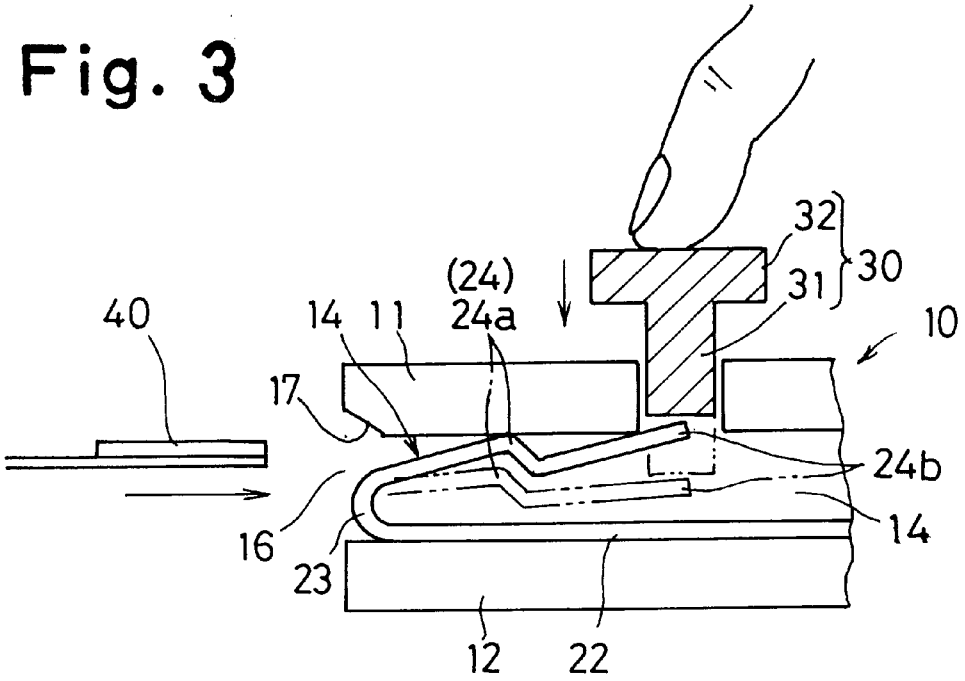
FIG. 3 is a sectional view of an FPC/FFC connector to explain the insertion operation of an FPC board or FFC; and, FIG. 4 is a sectional view of a contact leg portion of a contact and a pressing portion.

An insulator 10 of synthetic resin secured to a substrate B is provided with an upper wall 11, a lower wall 12, and a pair of side walls 13 to define a substantially rectangular insertion opening 14. The insulator 10 is also provided with a number of parallel contact insertion grooves 15 on the lower wall 12 opposed to the substrate B, and contacts 20 are inserted in the contact insertion grooves 15. In the illustrated embodiment, the end of the insulator 10 on which there is no contact insertion grooves 15 corresponds to the front side (inlet side) of the insertion opening 14 and the other end of the insulator 10 corresponds to the rear side, respectively.

Each contact 20 is comprised of a soldering leg portion 21 which is soldered to an associated terminal of the substrate B, an immovable leg portion 22 which extends along the inner lower surface 14*a* of the insertion opening 14 (i.e., the inner surface adjacent to the substrate B) toward the inlet end 16 of the insertion opening 14 in a direction substantially perpendicular to the soldering portion 21, a generally U-shaped bent portion 23 provided at the front end of the immovable leg portion 22, and an elastically deformable leg portion 24 which extends from the generally U-shaped bent portion 23 into the inner end of the insertion opening 14. The elastically deformable leg portions 24 are each provided with a contact leg portion (convex portion) 24*a* which comes into elastic contact with the inner upper surface 14*b* of the insertion opening 14 (inner surface furthest from the substrate B), and a pressure receiving leg portion 24*b* located in a more inward portion of the insertion opening 14 than the contact leg portion 24*a*. The insulator 10 is provided, on the end of the upper wall 11 thereof adjacent to the inlet end 16 of the insertion opening 14, with a tapered surface portion 17 corresponding to the U-shaped bent portion 23 to facilitate the insertion of a flexible printed circuit board or flexible flat cable (FPC/FFC) 40 into the insertion opening 14.

The insulator 10 is provided with a pusher sliding hole 18 which extends in a direction substantially perpendicular to the insertion opening 14. That is, the pusher sliding hole 18 is formed in such a manner that the axial direction of the hole 18 is perpendicular to the insertion opening 14.

In addition, the pusher sliding hole 18 is arranged to correspond to the pressure receiving leg portion 24*b* at the inner end of the hole 18. A pusher 30 is inserted in the pusher sliding hole 18. The length of the pusher 30 is such that the pusher 30 can simultaneously press the pressure receiving leg portions 24*b* of all the contacts 20 on the insulator 10. The pusher 30 is provided with a pressing portion 31 which is inserted in the pusher sliding hole 18 and an operating portion 32 to define a generally T-shape cross section.

In the FPC/FFC connector constructed as above, the contact leg portions 24*a* of the contact 20 are elastically brought into contact with the upper inner surface 14*b* of the insertion opening 14 and the pressure receiving leg portions 24*b* are located in the pusher sliding hole 18 before the FPC/FFC 40 is inserted. To insert the FPC/FFC 40, the opertaing portion 32 of the pusher 30 is pressed to depress the pressure receiving portions 24*b* by the pressing portion 31. Consequently, the elastically deformable portions 24 of the contacts 20 are entirely depressed and elastically deformed, so that the contact leg portions 24*a* are separated or disconnected from the inner upper surface 14*b* of the insertion opening 14. In this state, the FPC/FFC 40 is inserted onto the upper surfaces of the elastically deformable leg portions 24 through a space defined between the U-shaped bent portions 23 and the tapered surface portions 17. The deepest or maximum insertion position of the FPC/FFC 40 is restricted by the pressing portion 31 of the pusher 30 against which the front end of the FPC/FFC 40 abuts. When the external force which has been applied to the pusher 30 is released upon completion of insertion, the elastically deformable leg portions 24 are moved toward the inner upper surface 14*b* of the insertion opening 14 due to the elastic restoring force, so that the contact leg portions 24*a* come into contact with the corresponding terminals of the FPC/FFC 40.

The pusher 30 is used only to deform the elastically deformable leg portions 24 to thereby disconnect the same from the inner upper surface 14*b* of the insertion opening 14. Namely, after the FPC/FFC 40 is inserted and held between the contact leg portions 24*a* and the inner upper surface 14*b*, the pusher 30 is unnecessary. It is possible 10 to engage the pusher 30 with the insulator 10 by means of an appropriate engaging means. Alternatively, it is also possible to remove (detachably attach) the pusher 30 from (to) the pusher sliding hole 18 after the completion of the insertion of the FPC/FFC 40. The detachable attachment of the pusher 30 makes it possible to use a single common pusher for many insulators 10.

Figure 4:
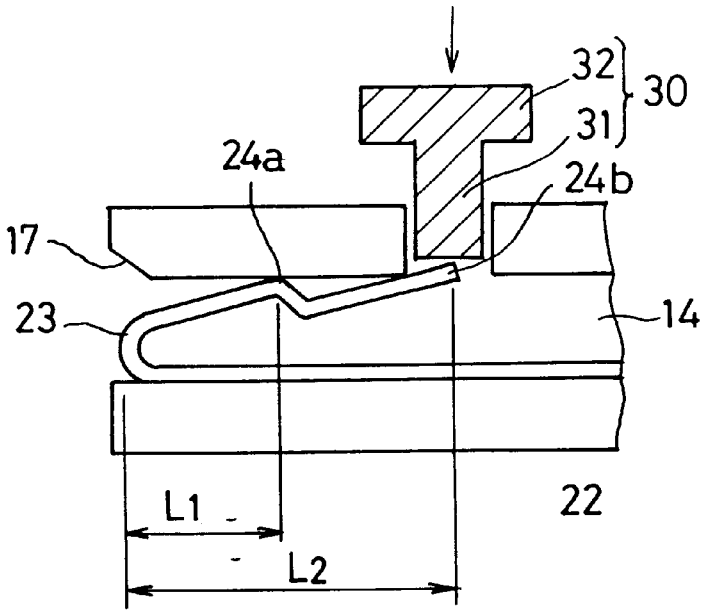

FIG. 4 shows the operational force of the FPC slider. In FIG. 4, assuming that the distance from the U-shaped bent portions 23 of the contacts 20 to the contact leg portions 24*a* is L1, and the distance from the U-shaped bent portions 23 of the contacts 20 to the pressure receiving portions 24*b* is L2, respectively, the elastically deformable leg portions 24 can be deformed to facilitate the FPC/FFC 40 by a smaller force when the L2 is longer than L1.

As can be seen from the above discussion, in an FPC/FFC connector according to the present invention, it is not necessary to insert a slider in the insertion opening of the insulator together with the FPC/FFC, and hence, the FPC/FFC can be connected only by the depression of the pusher. Moreover, according to the present invention, since no slider is used, there is no fear of a disengagement of the slider or a disengagement of the FPC/FFC caused thereby.

What is claimed is:

1. A connector for a flexible printed circuit board or flexible flat cable, comprising:

an insulator body having a contact receiving chamber and an insertion open at one end of said body and communicatng with said chamber, said insertion opening and chamber being configured to receive part of a flexible printed circuit board or of a fleidble flat cable having a thickness and inserted through said opening and into said chamber in an insertion direction, said insulator body also having a pusher bar sliding hole positioned substantially at theiother ed and spaced from said one end of said body in said insertion direction and communicating with said chamber, a plurality of contacts supported by said insulator body in said chamber, said chamber having an inner surface, each of said contacts including an elastically yieldable leg portion and each of said leg portions having a contact portion and a free end portion extending away from said contact portion in said insertion direction, which contact leg portions are elastically positioned at first positions against said inner surface of said chamber when said board or cable is not received in said chamber, and a pusher bar having a pressing portion extending thereon receivable in said pusher bar sliding hole for movement of said pusher bar relative to said insulator body between operative and inoperative positions, said pusher bar when in said operative position engaging said free end portions of said contact leg portions and elastically deforming said leg portions to position said contact portions away from said inner surface of said chamber by a distance greater than said thickness of said board or cable so as to allow said part of said board or cable to move freely between said contact portions and said inner surface, and said pusher bar when in said operative position also extending into said chamber so as to limit, by engagement with said board or cable, the extent to which said board or cable can be inserted into said chamber, said contact portions of said leg portions when said pusher bar is in said inoperative position either assuming said first positions and thereby inhibiting free insertion of said board or cable part into said chamber if said board or cable part is not already in said chamber, or coming into elastic engagement with said board or cable part if said board or cable part is received in said chamber to the extent determined by said board or cable part having come into engagement with said pusher bar during the insertion of said board or cable Part into said chamber while said pusher bar was in operative position.

2. A connector according to claim 1, wherein:

said contacts are each provided with an immovable leg portion which extends along said inner surface of said chamber generally parallel to said contact leg portion, said immovable leg portion having one end connected to said contact leg portion by a U-shaped bend, said immovable leg portion also having a second end opposite said one end, and each of said contacts is each further provided with a soldering leg portion connected to said second end of said immovable leg portion and which soldering leg portion extends toward a substrate to which said insulator body is to be secured.

3. A connector according to claim 2, wherein:

each of said free end portions of said elastically deformable leg portions has a pressure receiving portion which can be pressed by said pusher.

* * * * *